US008371821B1

(12) United States Patent
Mehr

(10) Patent No.: US 8,371,821 B1
(45) Date of Patent: Feb. 12, 2013

(54) GREEN WASTE WATER PUMP STATION CONTROL SYSTEM

(76) Inventor: Nasser Fred Mehr, Fort Lauderdale, FL (US)

( * ) Notice: Subject to any disclaimer, the term of this patent is extended or adjusted under 35 U.S.C. 154(b) by 0 days.

(21) Appl. No.: 13/588,840

(22) Filed: Aug. 17, 2012

(51) Int. Cl.
*F04B 41/06* (2006.01)
*F04B 49/04* (2006.01)

(52) U.S. Cl. ..... 417/8; 417/7; 417/12; 417/40

(58) Field of Classification Search ..... 417/5, 7, 417/8, 12, 40
See application file for complete search history.

(56) References Cited

U.S. PATENT DOCUMENTS 3,741,683 A * 6/1973 McTamaney et al. ..... 417/7
4,341,983 A * 7/1982 Gottliebson ..... 318/102
4,437,811 A * 3/1984 Iwata et al. ..... 417/8
5,909,352 A * 6/1999 Klabunde et al. ..... 361/191
6,186,743 B1 * 2/2001 Romer ..... 417/3
2008/0011377 A1 * 1/2008 Van Hooren et al. ..... 138/118
2009/0202359 A1 * 8/2009 Duncan ..... 417/43

* cited by examiner

*Primary Examiner* — Charles Freay

(57) ABSTRACT

An electrical control system for energy efficient pump stations providing for continuous operation of a single primary pump with a second pump functioning as the support pump and a third pump acting as the standby/emergency pump. All pumps are of equal horsepower and horsepower selection is determined by the system curve to select the lowest, most efficient horsepower necessary to discharge water at the highest inflow rate while not allowing the water level to drop below the submerged pump level during continuous running of the primary pump. A timer having an indicator arm rotates one full revolution every thirty days changing the pump sequence to reduce wear and tear on individual pumps. Each pump functions as the primary, secondary and backup/emergency pump for the same number of hours during the monthly cycle. Adding control circuits enables one or more pumps to be added when necessary.

2 Claims, 3 Drawing Sheets

THE ELECTRIC DIAGRAM FOR
A SUBMERGED PUMP

SCHEMATIC OF ELECTRICAL DIAGRAM
POWER CIRCUIT AND CONTROL CIRCUIT

View 1

View 2

GREEN THREE PUMP LIFT-STATION
LOCATION OF THE START, STOP AND
OVERFLOW CONTROL SWITCH
ELEVATIONS

GREEN WASTE WATER PUMP STATION CONTROL SYSTEM

CROSS REFERENCE TO RELATED APPLICATION

The invention of this Control System is unique as it is designed to control the operation of the pumps as presented in the Energy Saving Green Waste Water Pump Station Design concept (patent pending application Ser. No. 13/335,908).

BACKGROUND OF THE INVENTION

Pumping stations in sewage collection systems, also called lift stations, are normally designed to handle raw sewage that is fed from underground gravity pipelines (pipes that are laid at an angle so that a liquid can flow in one direction under gravity). Sewage is fed into and stored in an underground pit, commonly known as a wet well. The well is equipped with electrical instrumentation to detect the level of sewage present. When the sewage level rises to a predetermined point, a pump will be started to lift the sewage upward through a pressurized pipe system called a sewer force main from where the sewage is discharged into a gravity manhole. From here the cycle starts all over again until the sewage reaches its point of destination—usually a treatment plant. By this method, pumping stations are used to move waste to higher elevations. In the case of high sewage flows into the well (for example during peak flow periods and wet weather) additional pumps will be used. If this is insufficient, or in the case of failure of the pumping station, a backup in the sewer system can occur, leading to a sanitary sewer overflow and the discharge of raw sewage into the environment.

Sewage pumping stations are typically designed so that one pump or one set of pumps will handle normal peak flow conditions. Redundancy is built into the system so that in the event that any one pump is out of service, the remaining pump or pumps will handle the designed flow. In these days there are a lot of electronic controllers in the market designed specially for this application. The storage volume of the wet well between the 'pump on' and 'pump off' settings is designed to minimize pump starts and stops, but not enough to enable the pump to run continuously.

Traditional sewage pump stations incorporate both a wet well and a dry well. More modern sewage pumping stations do not require a dry well or pump house and usually comprise only a wet well. In this configuration, submersible sewage pumps with closely coupled electric motors are mounted within the wet well itself, submerged within the sewage. Due to the much reduced health and safety concerns, and smaller footprint and visibility, submersible pump sewage pumping stations have almost completely superseded traditional dry-well sewage pumping stations.

Control panels provide the electrical power required to operate submersible pumps in lift stations. The traditional waste water pump station design requires five float switches including two sets of starts and stops for the primary pump (Pump-A) and the second pump (Pump-B) with the fifth float switch controlling the emergency alarm. Start switches for Pump-A and Pump-B are located at the wet well mid-elevation and are about six inches apart from each other. The lower start switch turns on Pump-A and the higher start switch turns on Pump-B. Both stop switches of Pump-A and Pump-B are located about six inches lower than the top of the motor and stop both pumps at the same time. A logic controller handles typical float switch and pump failures and can continue to operate the lift station on only one functioning float switch.

Efforts to improve energy efficiency of pump stations and to reduce maintenance costs of the pumps have been made over the years. The continual rise of energy costs to power the pumps has strained municipal and state budgets at a time when revenues have fallen. Infrastructure maintenance competes for tax dollars and is often put off as budget cutting is forced. The most highly touted improvement was the introduction of variable speed pumps in pump station design. The variable speed pumps were proven to reduce energy costs in other applications. However, in studies done by Dr. Thomas Walski, P. E comparing variable speed pumping to constant speed pumps in systems for the relatively flat system head curves in water distribution systems (Walski, 2001, 2005, 2111; Walski, Bowdler and Wu, 2005), Dr. Walski found in each case, "when a pump is selected to correctly match the system, the constant speed pump has a lower energy cost than the variable speed pump whether the storage is on the discharge side as in elevated water storage or on the suction side as in a wet well at a sewage pumping station". So when are variable speed pumps more efficient? Dr. Walski states, "Variable speed pumping becomes more attractive in distribution systems that have no discharge side pumping and hence the pumps cannot be turned off. Instead, they must be run continuously." Since variable speed pumps are not more efficient in waste water pump stations and maintenance costs for variable speed pumps can be significantly higher than those for constant speed pumps plus the initial purchase cost of variable speed pumps is known to be higher than constant speed pumps, there is a need for a new method to reduce energy and maintenance costs without significant costs of retrofitting existing pump stations.

BRIEF SUMMARY OF INVENTION

The invention of this control system is designed to control the operation of the submerged pumps as presented in the Energy Saving Green Waste Water Pump Station Design concept (patent pending application Ser. No. 13/335,908). The pumps will be of minimum horsepower with a single pump running constantly after initial power up of the pump station. There are three or more submerged pumps run by this control system with the constant run pump functioning as the primary pump, a second pump having the role of the support pump and the third pump (in a three pump station) functioning as the standby/emergency pump. This invention includes a timer that controls the rotation of the pumps in their roles as primary, secondary and standby/emergency pumps. The timer control provides for each pump to function in each role equally each month so that wear and tear is reduced on the pumps. The detailed description section discusses the configuration of pump stations with three, four or more pumps. The control system to run the Energy Saving Green Waste Water Pump Station Design pump station has been invented so that energy and maintenance costs for running pump stations can be significantly reduced, greenhouse gasses associated with excessive energy usage in inefficient current pump station methods can be reduced, reduction of dependence on foreign oil can be achieved through efficiency and so that American jobs can be created through retrofitting current stations with this invention.

DETAILED DESCRIPTION OF INVENTION

This invention is the control method for green lift stations with three or more submerged pumps whereby the primary pump runs continuously. The specific embodiment shown in FIG. 2 relates to the control panel that operates a pump station under the Energy Saving Green Waste Water Pump Station Design concept (patent pending application Ser. No. 13/335,908). Further the embodiment shown in FIG. 3 relates to the float switch levels of a three pump lift station. The number of pumps in a lift station can be increased and the sequence of operation of this invention can be adapted to accommodate additional pumps as will be explained herein.

Figure 1:
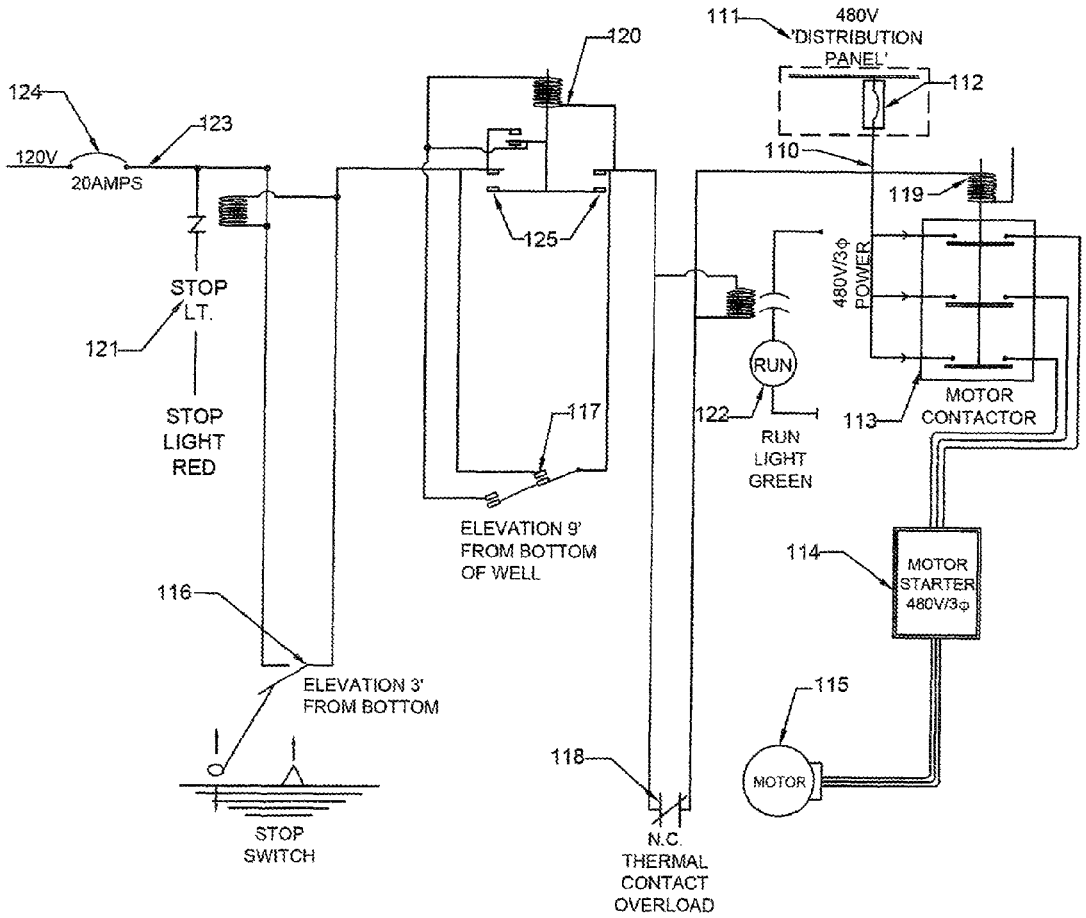
FIG. 1 is a schematic view of a control circuit suitable for a single submerged pump.

For better understanding of the control system in the Energy Saving Green Waste Water Pump Station Design, it is beneficial to first explain the operation of control of a submerged pump. FIG. 1 provides the electrical diagram operation of a submerged pump. In FIG. 1, there are two electrical circuits that are powered from two separate power sources. These are the pump's power circuit 110 and the pump's control circuit 123.

The pump's power circuit 110 is powered by three phase 480 volts or three phase 208 volts of electric power where the distribution panel 111 sends the current to the pump through the power circuit breaker 112 proceeding to the contactor 113. If the contactor 113 is closed by control, the power goes to the motor starter 114 causing the motor 115 to run.

The pump's control circuit 123 is powered by single phase 120 volts of electric power. The 120 volt current goes through the stop-switch 116, start-switch 117, overload relay 118 and energizes the actuator 119 of the contactor 113. The power circuit 110 and the control circuit 123 interact with each other only in the contactor 113. The total coordinated function of several elements in the power circuit 110 and the control circuit 123 will insure the safe operation of the pump.

The power circuit 110 elements include the distribution panel 111, the power circuit breaker 112, the contactor 113, the starter 114 and the motor 115. The distribution panel 111 is a load center which receives power from the utility network. The power supply to the distribution panel 111, in most cases, is three phase 480 volts or three phase 208 volts. In small lift stations, the power could be single phase 240 volts. The power circuit breaker 112 is part of the distribution panel 111 and serves two purposes. First, it acts as a manual make and break of the pump's power circuit 110. Second, it serves as a safety device to protect the pump motor from burning up due to motor 115 overload. The contactor 113 is an automatic make and break of the pump's power circuit 110. The interaction of control with the power circuit 110 is through the actuator 119. The starter 114 reduces rushing current and protects the motor 115 from burning. The rushing current of a motor due to the absence of electro-magnetic force within the motor is six to seven times that of the rated full load current. The motor 115 usually is a sealed three phase motor.

The control circuit 123 elements include a 120 volt power supply usually coming from a three phase panel of 208 volts/120 volts or single phase of 240 volts/120 volts; a 20 amp control circuit breaker 124 which makes and breaks power to the control circuit 123; a stop switch 116 that acts as a motor 115 protective device by ensuring the motor 115 remains fully submerged; a start switch 117 whereby closing it's primary float switch and auxiliary contactor 125 by way of the auxiliary relay 120 the pump starts to run and continues to run until the water level drops down to the stop switch 116 at which time the pump stops; an overload relay 118 that normally is a closed relay, is thermal and when the motor 115 becomes hot due to overload, the relay 118 will break the control circuit 123 and stop the motor 115 by way of the actuator 119. When the motor 115 cools down, the relay 118, having a bimetal element, will connect the circuit. The actuator 119 coordinates the function of all elements in the control circuit 123 on the power circuit 110. It is the means of interaction of control on the power circuit 110. Light indicators 121 & 122 are also elements of the control circuit 123. When the pump is stopped, the red light indicator 121 will turn on. The green light indicator 122 will turn on when the pump is running.

Figure 2:
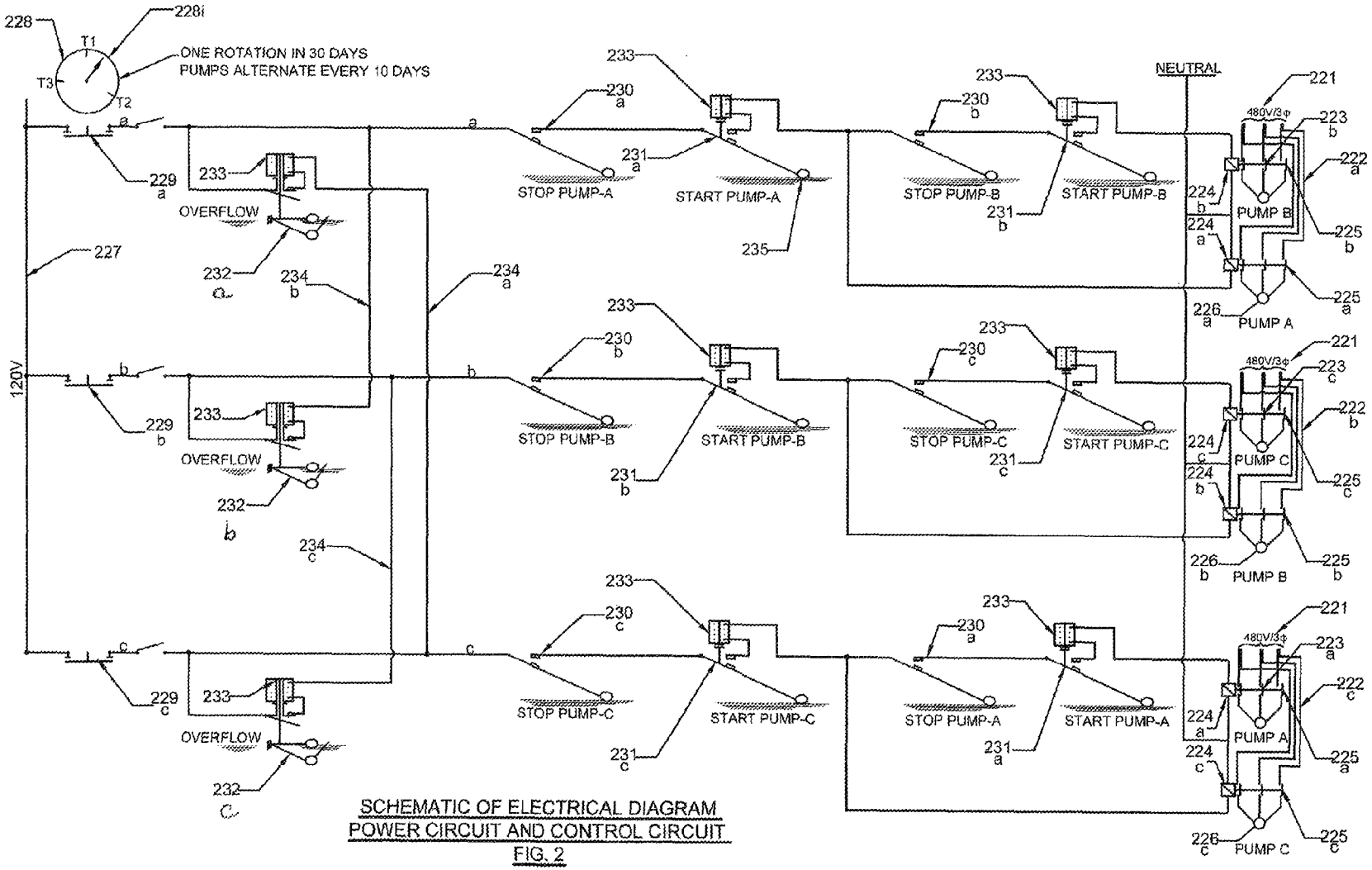
FIG. 2 is a schematic view of the electrical diagram for the power circuit and the control circuit for three submerged pumps further providing for continuous operation of a single pump, the support of a second pump and the operation of a standby/emergency pump. The figure includes the timer that controls the primary, secondary and standby/emergency pump running sequence.

Having an understanding of the operation control of a submerged pump, discussion now proceeds to the components of the Green Waste Water Pump Station Control System. FIG. 2 illustrates the components of the Green Waste Water Pump Station Control System. This control system is an expansion of the diagrams and processes explained in FIG. 1 for one submerged pump and it has been developed to insure that the operation of a lift station functions in accordance with the Energy Saving Green Waste Water Pump Station Design concept (patent pending application Ser. No. 13/335,908). This system works as a result of the cooperation and coordination of several collective elements, each having special functions. Some of the elements will have a single function while others may have multiple functions.

The power circuits 222*a*, 222*b* and 222*c* as shown in FIG. 2 provide electric power to pumps 226*a*, 226*b* and 226*c* FIG. 2. The power source for power circuits 222*a*, 222*b* and 222*c* is three phase 480 volt or three phase 208 volt power supplied from the power utility. The distribution panel 111 FIG. 1 (not shown in FIG. 2) is a load center having an enclosure, bus bar and circuit breakers. The power circuit breakers 112 FIG. 1 (not shown in FIG. 2) are devices providing a manual means to safely connect or disconnect the power circuits 222*a*, 222*b* and 222*c* even under load, in other words, when the pump rated current is passing through its power circuit. Circuit breakers 112 FIG. 1 (not shown in FIG. 2) for power circuits 222*a*, 222*b* and 222*c* also are safety devices and will interrupt the power to the pumps 226*a*, 226*b* and 226*c* when the current is larger than 115% of the motor rated amps. Most manufacturers provide 15% as the overload safety factor for one hour of motor operation. When the power circuit breaker 112 acts as the safety device, a timely response to protect the motor is dependant on the magnitude of the overload. Slowing action or thermal overload at a rate of 45% to 500% of the pump rated current determines the timing for the breaker 112 to act which may be 30 seconds to a few minutes. The acting device is a bi-metal element and acts by elevation of temperature. When there is a very large overload, the magnetic overload of the breaker 112 interrupts the current instantaneously, on the order of a fraction of a second. The action is by magnetic force generated by a coil which is in series with the circuit 222*a*, 222*b* and 222*c* and 100% of the current passing through it.

Contactors 223*a*, 223*b* and 223*c* FIG. 2 are also elements in the power circuits 222*a*, 222*b* and 222*c*, automatically connecting or disconnecting the power to the pumps 226*a*, 226*b* and 226*c*. Control circuits a, b & c FIG. 2 supervise the operation of the pumps 226*a*, 226*b* and 226*c* only through the contactors 223*a*, 223*b* and 223*c*. The effect of control on the power circuits 222*a*, 222*b* and 222*c* is by the actuators 224*a*+225*a*, 224*b*+225*b* and 224*c*+225*c* FIG. 2. Actuators 224*a*+225*a*, 224*b*+225*b* and 224*c*+225*c* automatically connect or disconnect the power circuits 222*a*, 222*b* and 222*c* through the contactors 223*a*, 223*b* and 223*c*. The actuators 224*a*+225*a*, 224*b*+225*b* and 224*c*+225*c* have two components. They are the actuator coils 224*a*, 224*b* and 224*c* and the actuator arms 225*a*, 225*b* and 225*c*. The actuator arms 225*a*, 225*b* and 225*c* have movable contact parts attached to them. The actuator coils 224*a*, 224*b* and 224*c* provide electromagnetic force when energized by the current from control circuits a, b & c. This magnetic force pulls the actuator arms 225*a*, 225*b* and 225*c* closing the power circuits 222*a*, 222*b* and 222*c*. The actuator arms 225*a*, 225*b* and 225*c* are made of pure iron rod. The force of the magnet closes the contacts and in the absence of the magnetic force, the spring action breaks the contacts. The motor starter 114 FIG. 1 (not shown in FIG. 2) reduces the rush in current and prevents the motors 226*a*, 226*b* and 226*c* from overheating at the start. The motors 226*a*, 226 *b* and 226*c* are three phase submerged pump motors, fully closed with a mechanical seal.

In FIG. 2, control circuits a, b and c provide for the safe operation of the lift station. The control circuit system is a combination of several elements. The action of each element occurs at a certain time and the coordination & cooperation of the elements is essential for the successful operation of the lift station. The components are the power source 227, the timer 228, the timer contactors 229*a*, 229*b* and 229*c* and the indicator arm 228*i*. The power source 227 usually is 120 volts, single phase from a low voltage distribution panel of three phase 208 volts or single phase 240 volts. It is essential that the pumps 226*a*, 226*b* and 226*c* run in sequence with equal running time to insure all three pumps 226*a*, 226*b* and 226*c* experience the same wear and tear. To change over the pump operation automatically, timer contactors 229*a*, 229*b* and 229*c* are added to control circuits a, b and c. The timer contactors 229*a*, 229*b* and 229*c* connect the 120 volts of control power to control circuits a, b and c in sequential manner. The timer 228 is similar to a clock in that the timer 228 face has 30 divisions each representing one day. A single indicator arm 228*i* on the timer 228 rotates clockwise with one full rotation occurring over a 30 day period. If position T1 FIG. 2 is zero days, then positions T2 FIGS. 2 and T3 FIG. 2 will be ten days and twenty days respectively. The timer contactors 229*a*, 229*b* and 229*c* are in series with the control circuits a, b and c and connect or disconnect the 120 volt power source to the control circuits a, b and c when the timer indicator 228*i* is in position T1 or T2 or T3 and energize or de-energize the respective contactor coils 229*a*, 229*b* and 229*c*.

The operation of the timer contactors 229*a*, 229*b* and 229*c* begins with the indicator arm 228*i* at position T1 or zero days. The coil of contactor 229*a* will energize thereby connecting control circuit a to the 120 volt power source while the two other circuits b and c have no power and are disabled. Under this condition, Pump-A 226*a* runs as the primary pump. Pump-B 226*b*, on circuit a, runs as the secondary pump and Pump-C 226*c*, on circuit c which is energized by the closing of the overflow switch 232*a* so that the overflow circuit 234*a* brings power to circuit c, is the standby/emergency pump that will run under emergency conditions. Contactor 229*a* remains energized for a period of ten days until the indicator arm 228*i* reaches point T2. At this time, contactor 229*b* is energized so that current now powers control circuit b. Pump-B 226*b* has now become the primary pump. Pump-C 226*c*, on circuit b, becomes the secondary pump and Pump-A 226*a*, on circuit a powered by overflow circuit 234*b* when overflow switch 232*b* is connected, becomes the standby pump for emergency operation. Pump-B 226*b* runs continuously for ten days as the primary pump until the indicator arm 228*i* reaches point T3 thereby energizing control circuit c. Pump-C 226*c*, on circuit c, begins operation as the primary pump. Pump-A 226*a*, on circuit c, operates as the secondary pump and Pump-B 226*b*, on circuit b powered by overflow circuit 234*c* when overflow switch 232*c* is connected, becomes the standby pump for emergency operation. After continuous operation of Pump-C 226*c* as the primary pump for ten days, the indicator arm 228*i* reaches point T1 and the above cycle repeats every thirty days.

The following discussion applies to elements in the FIG. 2. In order to simplify the reading, whenever references are to drawing elements that apply to "a" "b" and "c" in general, only the numerical reference will be given. For instance, references for float switches 230*a*, 230*b* and 230*c*, 231*a*, 231*b* and 231*c* and 232*a*, 232*b* and 232*c* will simply be identified as 230, 231 and 232. Float switches 230, 231 and 232 are water level control devices that are stationary at desired elevations. Their effect on control is by connecting or disconnecting the power to the control circuits a or b or c. The connecting and disconnecting action of the float switches 230, 231 and 232 is mechanical and is accomplished by the forces of floater buoyant force or floater gravity force. There are two kinds of float switches, break (stop switch) 230 and make (start switch) 231 and 232. Stop switches 230 break the 120 volt power to the actuator coil 224 stopping the motor 226. When a pump motor 226 is running, discharging the water causes the water level to drop down to an elevation slightly below the stop switch 230 level. At this point, the stop float is out of the water and the weight of the stop floater will break the control circuit a or b or c followed by the power circuit 222 stopping the pump 226. The stop switch 230 works by stop float weight (a stop float is similar to the typical start float 235 identified in FIG. 2). The start switches 231 and 232 act when the water level rises slightly higher than the floater level. The net force of buoyancy minus weight will close control circuit a, b or c, depending on the position of the timer indicator arm 228*i*, and energize the actuator 224. The actuator 224 closes the motor contactor 223 and establishes 480 volts of power in the pump's power circuit 222. The pump 226 starts and begins discharging water out of the well 300 FIG. 3 causing the water level to drop down. As soon as the water level drops down a few inches below the level at which the stop switch 231 floater is fully elevated, the stop switch 231 floater is out of the water and its weight will pull down the start switch 231 interrupting the power to the actuator 224 thereby stopping the pump 226. In situations where the water level repeatedly moves a few inches up and then a few inches down, the motor 226 starts and stops frequently, the contactor 231 almost shatters and the motor 226 will burn. For the pump 226 to continuously run until being stopped by the action of the stop switch 230, the continuity of the current through the start switch 231 should be maintained. The auxiliary relay 233 sustains the current to the actuator 224 by its coil 120 FIG. 1 being energized by the initial action of the start switch 231 and its own auxiliary contactor 125 FIG. 1.

To explain the operation of the standby/emergency pump start switch 232*a*, the operation of the system where Pump-A is the primary pump, Pump-B is the secondary pump and Pump-C is the standby/emergency pump will be given. This occurs when the timer indicator arm 228*i* is in position T1 so that control circuit a is energized. When the water level in the wet well 300 is elevated above the standby/emergency pump 226*c* start switch 231*c* level, the operation of the standby/emergency pump 226*c* becomes essential. Responding to this emergency condition, the start switch 231*c* closes the emergency control circuit c but control circuit c still has no power to command the operation of the standby/emergency pump 226*c*. Further elevation of the water will close the overflow switch 232*a* energizing control circuit c through control circuit a so that Pump-C, functioning as the standby/emergency pump 226*c*, begins operation.

A pump station operating under the Energy Saving Green Waste Water Pump Station Design concept (patent pending application Ser. No. 13/335,908) operates differently than those operating under traditional pump station designs. Pump stations designed under the traditional method have two or more pumps that turn on and off as determined by water levels. One pump is the lead pump and the other is the lag pump so that they do not start simultaneously. However, the two pumps do in fact run together and stop at the same time. In contrast, the Energy Saving Green Waste Water Pump Station has a minimum of three pumps 226*a*, 226*b* and 226*c*. The location of the indicator arm 228*i* on the timer 228 determines which control circuit a, b or c is energized. When control circuit a is energized, Pump-A 226*a*, is continuously running as the primary pump 226*a*. The second pump, Pump-B 226*b*, supports the primary Pump-A 226*a* when the water level rises to the start switch level 231*b* (located on circuit a) and backup/emergency Pump-C 226*c* runs if one of the first two pumps fails or when extreme water inflow conditions like tropical storms require additional pumping capacity. The case for four or more pumps will be explained later. The primary pump, Pump-A 226*a*, initially turns on when power is turned on to the pump station by manually turning on the power at the distribution panel 111 via the power circuit breaker 112. This occurs when a newly constructed pump station or one retrofitted under the Energy Saving Green Waste Water Pump Station Design begins operation. It also occurs after pump station maintenance requiring the powering down of the station has taken place.

Figure 3:
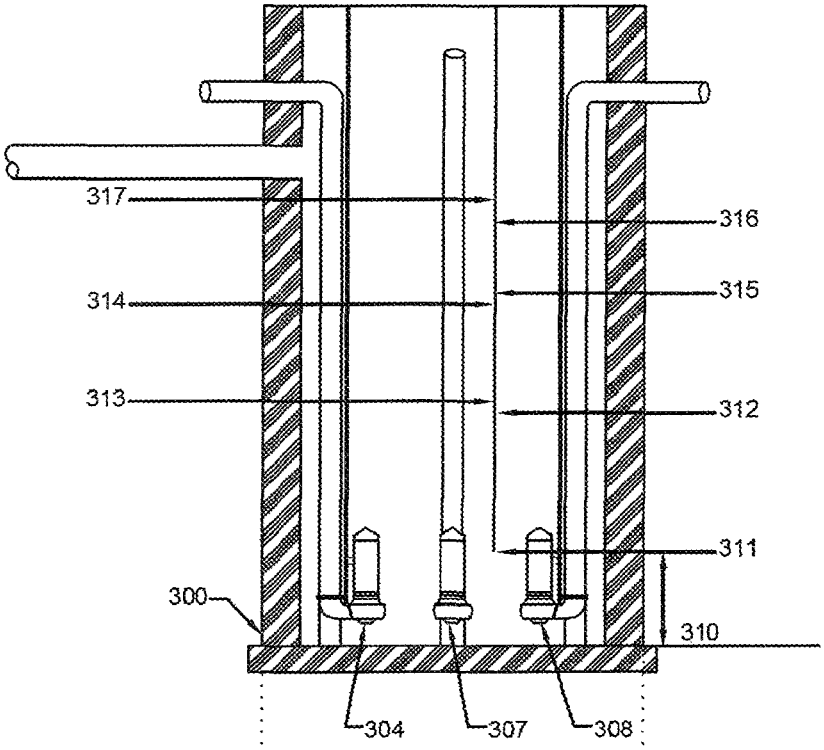
FIG. 3 provides a side view (View 1) and a top view (View 2) of a Green Three Pump Lift Station compatible for use with the Green Waste Water Pump Station Control System. The placement of the submerged pumps and the start and stop switches are identified.
Figure 3:
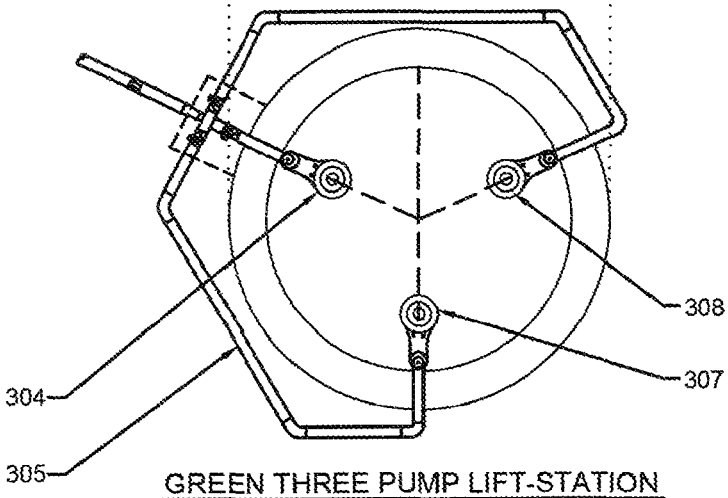

The operation of a full cycle sequence of the Energy Saving Green Waste Water Pump Station will be explained here. FIG. 3 (View 1) shows the location of the start, stop and overflow control switches in the three pump Energy Saving Green Waste Water Pump Station Design. FIG. 3 (View 2) shows the top view of the pumps in a three station. Under the condition where the timer indicator 228*i* FIG. 2 is in position T1 FIG. 2 so that circuit a FIG. 2 is the energized circuit, well water rising a few inches beyond the fully submerged pump elevation point 310 results in the buoyant force of the floater connected to stop switch 311 closing the stop switch 311 of primary Pump-A 307. When the water rises to the elevation of the start switch 312 of the primary Pump-A 307, the floater connected to start switch 312 closes the starter switch 312 of primary Pump-A 307 and primary Pump-A 307 starts to run. Primary Pump-A 307 continues to run until the dropping of the water level causes the Primary Pump-A stop switch 311 to break the 120 volts of control circuit a and primary Pump-A 307 will stop. Primary pumps run continuously under the Energy Saving Green Waste Water Pump Station Design and pump horsepower is predetermined with one pump continuous operation and energy conservation the primary focus. However, the primary pump stop switch is required so that if, for any reason the water level in the station drops below full pump submersion elevation 310, the pump will stop in order to protect the pump from overheating. Lowering the elevation of stop switch 311 for the purpose of increasing well capacity is limited to the submersion depth 310 of the pumps 304, 307 and 308. As long as the inflow rate is smaller or equal to the pump discharge, only Pump-A 307 will operate as the primary pump. When the inflow rate is larger than the discharge of Pump-A 307, the water level will rise to the elevation of stop switch 313 of Pump-B 304. This will result in the floater, attached to stop switch 313 of secondary pump Pump-B 304, closing the circuit so that the control power reaches to the line side of start switch 314. When the water level rises to the point that it reaches start switch 314 of Pump-B 304, Pump-B 304 will start to run as the secondary pump. If, due to unusually extreme conditions such as a major storm or the break of a water main, the inflow rate is larger than the discharge of Pump-A 307 plus that of Pump-B 304, then the water level will rise and close the stop switch 315 of standby/emergency Pump-C 308, and further up will close the start switch 316 of Pump-C 308. Since the timer contactor 229*c* FIG. 2 in control circuit c FIG. 2 is off, Pump-C 308 will not start. When the water level rises another six inches, the overflow switch 317 connects the 120 volts of power from circuit a FIG. 2 to control circuit c FIG. 2 through standby/emergency Pump-C 308 overflow circuit 234*a* FIG. 2 and the standby/emergency Pump-C 308 will start to run as the emergency pump. The overflow switch 317 also triggers an emergency alarm that is audible, turns on an external warning light and transmits a signal via cell phone or other communication device to the waste water plant operators. Under this condition, all three pumps are operating until lowering the water level disconnects the stop switch 315 of Pump-C 308 resulting in resuming normal operations with primary Pump-A 307 and secondary Pump-B 304 running.

After 10 days, the timer contactor 228*i* FIG. 2 connects the 120 volts of power to control circuit b FIG. 2. The components on control circuit b will function exactly as those identified above for circuit a. Connecting power to circuit b results in Pump-B 304 assuming the role as the primary continuous run pump, Pump-C 308 becomes the secondary pump and Pump-A 307 functions as the standby/emergency pump. After another 10 days, the timer contactor 228*i* connects the 120 volts of power to control circuit c. The components on control circuit c will function exactly as those identified above for circuits a & b. Connecting power to circuit c results in Pump-C 308 assuming the role as the primary continuous run pump, Pump-A 307 becomes the secondary pump and Pump-B 304 functions as the standby/emergency pump. The above full cycle will be repeated by the indicator arm 228*i* returning to position T1.

The Energy Saving Green Waste Water Pump Station Design also applies to lift stations having four or more pumps. Lift stations that regularly experience drastic changes in inflow rates often warrant the addition of one or more pumps to the three pump design. A 24 hour inflow profile revealing significant differences between the maximum and minimum inflows is the first step in identifying the four or more pump design station candidate. If the ratio of maximum to minimum of inflow is equal to or greater than three, the design of the well with four pumps is more feasible.

The Energy Saving Green Waste Water Pump Station Design controlled by this control system invention saves energy by employing three or more pumps with the lowest effective horsepower possible. Each pump is identical so that the sequencing process of rotating the pumps every ten days can be accomplished. This rotation of pumps extends useful life of the pumps and reduces maintenance costs. Increasing the horsepower of the three pumps instead of adding one or more pumps of equal horsepower increases energy costs. More importantly, the continuous run of the higher horsepower primary pump may result in the discharge rate exceeding that of the inflow thereby lowering the water below the fully submerged pump elevation resulting in frequent start and stops of the primary pump. This condition wears on or damages the running pump. An Energy Saving Green Waste Water Pump Station Design controlled by this invention for four pumps employs a fourth pump as the standby/emergency pump having one quarter of the total wet well horsepower versus one third of the horsepower installed in the three pump station.

Large re-pump stations also warrant additional pumps. In re-pump stations, the storage capacity has very little or no effect on water level regulation because of the large volume of inflow. It is essential that the pump capacity be large enough to respond to these inflows. For this reason, re-pump stations should be designed with a minimum of four pumps in such a way that three pumps are capable of discharging the inflow under worst case scenarios with the fourth pump functioning as the standby/emergency pump.

The Green Waste Water Pump Station Control System diagram for a four pump lift station operating under the Energy Saving Green Waste Water Pump Station Design concept is similar to that in FIG. 2 with three pumps. An additional circuit would be added for the fourth pump so that Pump-A runs as the primary pump, Pump-B runs as the secondary pump, Pump-C runs as the tertiary pump and Pump-D is the standby/emergency pump. The face of the timer 228 FIG. 2 will have four contactors positioned at 90 degrees off each other and the automatic change over of pumps occurs every seven and a half days.

I claim:

1. A green waste water pump station for pumping from a well, said green waste water pump station comprising:

a well into which waste water is fed from gravity pipelines; the well having a plurality of N submersible station pumps mounted at the bottom of the well, where N is greater than or equal to 3, the station pumps each having an outlet and the station pump outlets connecting to a common well discharge pipe; the station pumps being of equal horsepower whereby the horsepower is determined such that a single primary pump runs continuously after powering up without the water level dropping below the fully submerged pump height; a pump station set is assigned such that each of the N station pumps is successively numbered 1 to N; and a sequence controller for controlling the order of operation of the station pumps, the sequence controller including a power circuit associated with each of the station pumps, a timer having a timer total period and an indicator arm; and N control circuits each comprising a timer contactor, start and stop float switches, an overflow float switch and auxiliary relays;

said N timer contactors being arranged to contact said indicator arm and dividing said timer total period into N equal operating periods equal to said timer total period/N;

said sequence controller operating the station pumps by performing the following steps:

Step 1 assigning a variable PrimaryPump=1 and a variable OperatingPeriod=1; and then beginning operation of the timer; and beginning operation of the timer;

Step 2 assigning a pump station sequence with the primary pump being the station pump of said pump station set equal to PrimaryPump, a secondary pump being the station pump of said pump station set equal to PrimaryPump+1; with the successive pumps of the pump station sequence being numbered in order following the secondary pump, such that when ordering the successive pumps when station pump N is reached the next pump in the pump station sequence will be station pump number 1; the sequencing continuing until all N station pumps have been assigned to the pump station sequence, with the Nth pump in the pump station sequence being assigned as the backup/emergency pump;

Step 3 operating the pumps as assigned in the pump station sequence in response to the water level in the well and the activation and deactivation of the start and stop float switches during said operating period until the timer indicator arm contacts the next of the N timer contactors;

Step 4 assigning PrimaryPump=PrimaryPump+1, and OperatingPeriod=OperatingPeriod+1; if OperatingPeriod is greater than N then assigning PrimaryPump=1 and Operating Period=1; and Step 5 returning to step 2.

2. The green wastewater pump station as set forth in claim 1 wherein a face of said timer has 30 divisions each representing a day and said indicator arm rotates clockwise whereby one full rotation of the indicator arm occurs over a 30 day period.

* * * * *